United States Patent [19]

Pozzo et al.

[11] 4,338,773

[45] Jul. 13, 1982

[54] CONTROL MECHANISM FOR A FIBER FEED DEVICE ON AN OPEN END SPINNING MECHANISM

[75] Inventors: Hans Pozzo; Joachim Dammig, both of Ingolstadt, Fed. Rep. of Germany

[73] Assignee: Schubert & Salzer, Ingolstadt, Fed. Rep. of Germany

[21] Appl. No.: 102,545

[22] Filed: Dec. 11, 1979

[30] Foreign Application Priority Data

Dec. 23, 1978 [DE] Fed. Rep. of Germany ..... 2855924

[51] Int. Cl.[3] ..... D01H 13/18; D01H 13/16

[52] U.S. Cl. ..... 57/81

[58] Field of Search ..... 57/78, 81, 83, 261, 57/263

[56] References Cited

U.S. PATENT DOCUMENTS 3,404,524 10/1968 Rajnoha et al. ..... 57/81

3,764,773 10/1973 Merkle ..... 57/81 X 3,782,089 1/1974 Landwehrkamp et al. ..... 57/81 X 3,945,183 3/1976 Landwehrkamp et al. ..... 57/81 X 4,091,606 5/1978 Böttcher ..... 57/81 X

*Primary Examiner*—Donald Watkins

*Attorney, Agent, or Firm*—Dority & Flint

[57] ABSTRACT

A control mechanism for use on an open-end spinning machine provided with a sensor which senses tension in yarn being produced and a switching mechanism for interrupting a fiber feed device responsive to the sensor sensing a drop in yarn tension. The switching mechanism includes a switch-on member 3 and a main switch member 4 that is switched on upon actuation of the switch-on member for putting the sensor 10 and fiber feed device out of service. A switch-off member 5 is provided for switching off the main switch member 4 for putting the sensor and the fiber feed device 60 back into service.

5 Claims, 7 Drawing Figures

CONTROL MECHANISM FOR A FIBER FEED DEVICE ON AN OPEN END SPINNING MECHANISM

BACKGROUND OF THE INVENTION

The present invention refers to a control mechanism for a fiber feed device on an open-end spinning mechanism, which exhibits a sensor and a switching mechanism which is controlled from the sensor upon drop in the yarn tension. The switching mechanism, in turn, controls the operation of the fiber feed device via a control member.

In tying up the end of yarn carried on a package with the yarn being produced in the rotor of an open end spinning machine, the yarn end from the package follows the lead-back portion into the yarn draw-off tube and into the spinning chamber because of the reduced pressure prevailing in the spinning rotor. The lead-back can in that case be effected in various ways, e.g., by hand or by release of a yarn reserve or by turning back the delivery rollers and the bobbin. Depending upon whether the yarn is thick or thin or to what extent in that case it passes by points of deflection, the suction air flow existing at the mouth of the yarn draw-off tube obtains a different effect. Particularly in the case of fine yarns it occurs again and again that the end of the yarn sticks upon leading back or only follows the lead-back hesitatingly. Faulty joins thereby result upon starting the spinning unit. The yarn sensor has a particularly disadvantageous action here as it forces away the yarn which is not under draw-off tension and hence causes a deflection.

It has therefore already been proposed, for the leading back of the yarn into the spinning mechanism to swing the sensor out of the yarn breakage position into its opposite end position, so that the yarn may be guided back unimpeded into the yarn draw-off tube (West German Pat. No. 1,560,334). Since the sensor controls the feeding of the fiber directly, the disadvantage results that upon the freeing of the lead-back by the position of the sensor the fiber feed does not always get switched on at the required instant. That is, it has been found that for successful joining of the yarn it is extraordinarily important that the fiber feed is matched exactly to the leading back of the yarn so that the led back end of the yarn and a ring of fiber existing in the spinning rotor meet. This matching has to be effected in adaptation to the different materials, thicknesses of yarn, rotor speed, yarn drawn-off speed and possibly differing reduced pressure.

Again, a mechanism is known in which in the position of the sensor in which it is sensing the yarn the fiber feed is switched on, while in the yarn breakage position of the sensor the fiber feed is certainly switched off but by means of an auailiary switch may be switched on again at will (West German O/S No. 2,058,603, FIG. 1). If in the case of this mechanism the sensor is swung over in order to facilitate the introduction or leading back of the yarn into the spinning mechanism, the fiber feed is willy-nilly switched on too.

A mechanism is furthermore known in which the sensor at joining may be brought by a switching unit into the position in which the sensor switches on the fiber feed (West German O/S No. 2,058,603, FIG. 2). In this way the timing of the starting of the fiber feed is again dependent upon the position of the sensor.

The same disadvantage arises if the switch is arranged in a parallel circuit to the yarn monitor (West German O/S No. 2,058,603, Paragraph 2).

SUMMARY OF THE INVENTION

This problem is solved in accordance with the invention if the switching mechanism for the control member controlling the fiber feed device exhibits a switching-on member actuable upon drop in the yarn tension, a main switch member which is switched on by the switching-on member and puts the sensor and the fiber feed device out of service, as well as a switching-off member which switches off the main switch member and puts the sensor and the fiber feed device into service again. By the main switch member being actuated in dependence upon the drop in the yarn tension, the fiber feed is switched off and brought to rest immediately upon the occurrence of a yarn breakage. The main switch member also puts the sensor out of service so that the position or motion of the latter remains without effect upon the fiber feed device. Hence for the leading back of the yarn and for the joining the sensor may be brought into the most favorable position, i.e., into a position in which the sensor exposes the yarn draw-off tube so that the yarn may be introduced without deflection into the yarn draw-off tube or led back inside the latter. By a switching-off member which may be actuated manually or automatically, the main switch member is switched off again at the required time and thereupon the sensor is simultaneously brought into action again so that in dependence upon its position the fiber feed may again be controlled. In this way any starting time of the fiber feed may be chosen independently of the position of the sensor so that joining is very much facilitated and the reliability of the join is considerably increased since adaptation to variable factors in the joining is made possible in a simply way.

In order not to have to bring the sensor by hand into the position of readiness in which it exposes the yarn draw-off tube for the joining, a repulsion magnet is advantageously arranged in parallel with the control member for the fiber feed device and in series with the main switch member, and moves the sensor out of the end position in which it lies in the case of yarn breakage, into its other end position, the position of readiness. This leads to further facilitation of joining.

The switching-off member may be made in various ways. For example, a time element may be applied as switching off member, which is preset to correspond with the variable spinning factors. The switching-off member is advantageously made as a pushbutton switch, since the latter enables particularly simple control by a control drum in the case of which the adaptation is effected by adjustment of switching cams, or by hand.

In order to hold the sensor in the position of readiness during the starting of the fiber feed when the yarn tension usual during spinning has not yet been restored, the switching-off member is made as a bypass to the main switch member, which keeps the repulsion magnet switched on still during the actuation of the switching-off member.

The main switch member may likewise be made in various ways. Preferably in accordance with a particularly simple mechanism it is made as a thyristor to which the switching-on member feeds the ignition voltage, in which case the switching-off member is arranged in series with the control member for the fiber feed device and with the thyristor.

In order to be able at the beginning of the starting up process after the machine has been stationary, to bring the sensor into the position of readiness for joining, before the fiber feed is switched on and before the sensor becomes effective, in accordance with a further feature of the invention a switch member controlled by a main control mechanism, e.g., a starting drum, is provided in series with the repulsion magnet and in parallel with the main switch member.

The present invention leads to a raising of the reliability of joining and to an improvement in the join, since the starting time of the fiber feed may be adapted at will to the variable factors in the joining.

Accordingly, it is an important object of the present invention to create a mechanism which enables unimpeded leading back of the yarn into a spinning chamber and exact matching of the fiber feed to the leading back of the yarn.

Another important object of the present invention is to provide a control mechanism which permits the leading back of yarn from a package on an open-end spinning machine into a spinning chamber with a normal yarn tensioning device positioned on the side of the yarn that it assumes in a sensing position.

These and other objects and advantages of the invention will be seen upon reference to the following specification, attendant claims and drawings.

DESCRIPTION OF A PREFERRED EMBODIMENT

Figure 6:
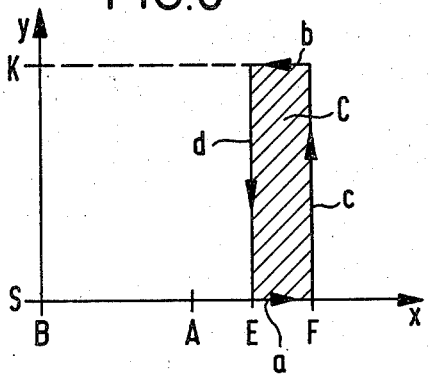
FIG. 6 is a chart illustration the duration of the switch-off of the feed mechanism in the case of known control mechanisms for fiber feed mechanisms.
Figure 7:
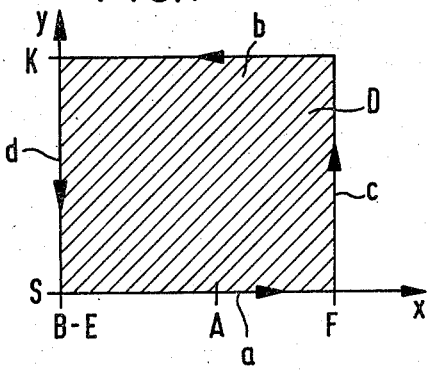
FIG. 7 is a graphic illustration showing the duration of the switch-off of the feed mechanism in the case of the control mechanism constructed in accordance with the invention for a fiber feed mechanism.

In order to make clear the essence of the object of the invention the switching behavior of the known control mechanism for the fiber feed mechanism must first of all be compared with the switching behavior of the control mechanism in accordance with the invention with the aid of FIGS. 6 and 7.

On the abscissa x of the graphs there is shown at the extreme left the position of readiness B of a sensor 10 sensing a yarn 1 (FIG. 2) drawn down from an open-end spinning mechanism, in which position the sensor 10 is lying during joining, in order to expose the yarn draw-off tube 12 of the open-end spinning mechanism. In the sensing position A the sensor 10 senses the yarn 1 during spinning. In the yarn breakage position F of the sensor 10, as is described in greater detail later, it actuates a control mechanism 6 for a fiber feed mechanism 60 in order to interrupt the fiber feed into the spinning mechanism. The point E finally characterizes the position of the sensor 10 in which upon swinging back the sensor 10 into the sensing position A or into the position of readiness B, the fiber feed into the spinning mechanism gets switched on again. On the ordinate y the switched on fiber feed is characterized by point S, while point K indicates that the fiber feed is out of service. The arrow a indicates that the switching-off of the fiber feed characterized by the arrow c is effected by movement of the sensor into the yarn breakage position F, while the arrow b indicates that the switching-on of the fiber feed characterized by the arrow d is effected by movement of the sensor out of the yarn breakage position F in the direction towards the sensing position A. It goes without saying that reasons of manufacture (tolerances to be maintained) the switching-off point for the fiber feed does not coincide with the point of stoppage of the sensor 10 in the yarn breakage position F but this switching-off point lies already a little in front of the point of stoppage.

In the case of the known mechanisms the control of the fiber feed is always effected in dependence upon the position of the sensor 10, in which case the fiber feed is switched off merely in or respectively round about the yarn breakage position F of the sensor. The switched-off state of the feed is characterized in FIG. 6 by the area C.

In contrast to this, in the case of the mechanism in accordance with the invention, it is only the switching-off of the fiber feed which is effected in dependence upon the sensor in its yarn breakage position F. As is explained in greater detail again later, it is sufficient if the switching-off of the fiber feed lies at any point between the sensing position A and the yarn breakage position F of the sensor 10, since after switching-off of the fiber feed, switching-on of it is independent of the position of the sensor 10. Hence the sensor 10 may be brought into the position of readiness B without fibers being at the same time fed into the spinning mechanism. Only at the desired instant when the sensor is already lying in the position of readiness B does the fiber feed get switched on again, wherefore in the case of the mechanism in accordance with the invention the point E for the switching-on of the fiber feed comes to coincide with the position of readiness B of the sensor 10 in which the mouth of the yarn draw-off tube 12 is exposed by the sensor 10. The switched-off state of the feed is characterized in FIG. 7 by the area D.

Figure 1:
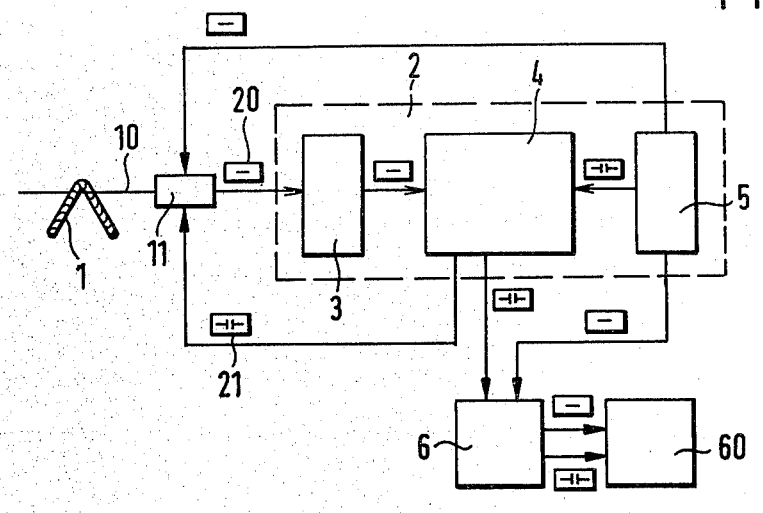
FIG. 1 is a diagrammatic illustration of a control mechanism constructed in accordance with the present invention.
Figure 2:
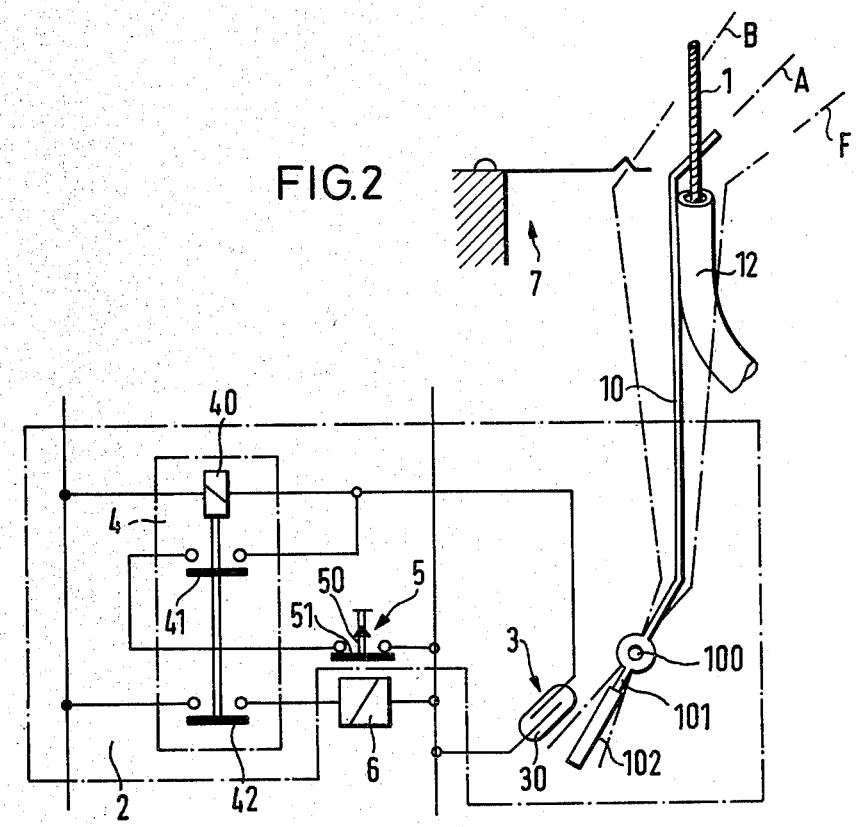
FIG. 2 is a more detailed schematic diagram of the circuit illustrated in FIG. 1.

In order to be able to choose the point E for the switching-on of the fiber feed at will, independently of the position of the sensor 10 monitoring the tension of the yarn 1 in accordance with FIG. 1 a switching mechanism 2 is provided, which exhibits a switching-on member 3, a main switch member 4 and a switching-off member 5. The switching-on member 3 is actuated by the sensor 10 of the yarn monitor 11 in the case of yarn breakage, whereupon the sensor 10 in known manner by gravity or spring or magnetic force moves from the scanning position A into the yarn breakage position F (FIG. 2).

The main switch member 4 is switched on by the switching-on member 3 and actuates the control mechanism 6 whereby the yarn feed device 60 is put out of service. Furthermore the main switch mechanism 4 puts the sensor 10 out of service.

The processes of putting in and out of service or respectively of switching on and off are characterized in FIG. 1 by symbols 20 and 21; the symbol 20 characterizes the switching-on or respectively putting into service, while the symbol 21 characterizes the switching-off or respectively putting out of service of an element.

A switching-off member 5 which is controlled independently of the position of the sensor 10 is provided in order to put the main switch member 4 again out of service. The switching-off member 5 may in that case be controlled by hand or by a main control mechanism which is not shown. The switching-off member 5 brings the sensor 10 into action again and actuates the control mechanism 6 which switches on the fiber feed device 60 again.

It may clearly be seen from FIG. 1 that the switching-on of the fiber feed device 60 is effected completely independently of the position of the sensor 10, so that this switching-on may be effected if the sensor 10 is lying in the position of readiness B (FIG. 2). In this way the introduction of the yarn 1 into the yarn draw-off tube 12 as well as the leading of the yarn 1 back up the yarn draw-off tube 12 into the open-end spinning mechanism may be performed unimpeded. Furthermore the point E for the switching-on of the fiber feed device 60 may be adapted in an optimum way to the spinning conditions presented by different fiber materials, varying speeds, different yarn counts, etc. Greater reliability in joining is hereby achieved; the appearance and the strength of the point of joint in the yarn 1 are improved too.

The instant of switching-off of the fiber feed device 60 may be chosen somewhat more freely and does not have to coincide with the yarn breakage position F of the sensor 10. For example, the sensor 10 may release the switching-on member 3 again already in the yarn breakage position F, since the switching-on of the yarn feed device 60 is effected independently of the position of the sensor 10, so that the switching-off of the yarn feed device 60 may, for example, be effected at any position of the sensor 10 between its sensing position A and its yarn breakage position F. Various embodiments are to be described with the aid of FIGS. 2 to 5.

In FIG. 2, the sensing position A, the yarn breakage position F and the position of readiness B of the sensor 10 are shown. The sensor 10 in the embodiment shown is supported pivotally about a point of rotation 100 and exhibits a second arm 101 having a permanent magnet 102 for actuation of a switching-on member 3 made as a proximity switch 30. A relay or contactor 40 is provided in series with the switch 30, which forms together with its contacts 41 and 42 the main switch member 4. The contact 41 is a hold-in contact and is therefore arranged in series with the relay or contactor 40 and in parallel with the switch 30. In series with the contact 41 and in parallel with the switch 30 lies the contact 51 of a pushbutton switch 50 which forms the switching-off member 5. In parallel with the switch 30 and the relay or contactor 40 as well as the contact 41 and the contact 51 there are arranged in series with one another the contact 42 and the control mechanism 6 for the fiber feed device 60 (FIG. 1).

In the sensing position A of the sensor 10 are shown in FIG. 2 the switch 30 is not actuated by th permanent magnet 102. Hence also the relay or contactor 40 is not excited so that the contract 42 is open. Hence the control mechanism 6 is not actuated, so that the fiber feed device 60 is switched on and the fibers are being fed into the open-end spinning mechanism where these fibers are being combined into the end of the yarn 1 which is being drawn off.

If the yarn tension drops, for example, because of a yarn breakage, the sensor 10 because of gravity drops into the yarn breakage position F in which the permanent magnet 102 closes the switch 30. Hence the relay or contactor 40 is energized and closes its contacts 41 and 42, whereby the fiber feed device 60 is put out of action and the fiber feed is interrupted. Since the relay or contactor 40 is held in via the contact 41 the sensor 10 may adopt any desired position at will without the fiber feed being influenced by it.

In order to be able to introduce the yarn 1 satisfactorily into the yarn draw-off tube 12 for the joining process, the sensor 10 is brought out of the yarn breakage position F into the position of readiness B. In doing so the permanent magnet 102 releases the switch 30. But since the relay or contactor 40 holds itself in via its contact 41 the interruption of the switch 30 remains without effect. At the desired instant during the carrying back and joining of the yarn the pushbutton switch 50 is now actuated, which is located at a suitable point. For example, the pushbutton switch 50 may be provided on the bobbin arm in accordance with the West German O/S No. 2,058,603. But it may also be arranged on the jacket which covers over the spinning mechanism or at any other point and depending upon whether the joining is effected automatically or by hand it may be actuated automatically by a control mechanism which is not shown or by hand. Upon actuation of the pushbutton switch 50 the supply of current to the relay or contactor 40 is interrupted so that it now drops out and opens its contact 42. The control mechanism 6 thereby becomes de-energized, whereby the fiber feed device 60 gets switched on again and feeds fibers into the open-end spinning device where they get combined into the tip of the end of yarn which has been carried back. After joining has been effected, the operator releases the sensor 10 again which now moves out of the position of readiness B into the sensing position A and rests against the yarn 1, which may be brought about by gravity or spring or magnetic force.

In order that the operator does not have to hold the sensor 10 the whole time in the position of readiness B, a retainer 7 may be provided which holds the sensor 10 in the position of readiness B. In the execution shown in FIG. 2, the retainer 7 is made as a spring catch 70 which catches behind the sensor 10 when it is brought into the position of readiness B and hence holds the sensor 10 back until it is released again by raising the spring catch.

But it is also conceivable to provide a magnet as the retainer 7 or to make use of the permanent magnet 102 also for this purpose. The magnetic force of the magnet may be overcome by mechanical pressure against the sensor 10 directly or via an intermediate lever.

The sensor 10 also does not have to be made as a two-armed lever but only needs to have one arm. The permanent magnet 102 may in that case be arranged so that it strengthens the force of recall of the sensor 10, e.g., in collaboration with an iron element so that gravity is strengthened by magnetic force. This iron element may in that case also be the iron core of a repulsion magnet (71—FIG. 4), which is explained in greater detail again later.

The switching-on member 3 is made in FIG. 2 as a proximity switch but it is also possible to make use of other switches, e.g., pushbutton switches.

Figure 4:
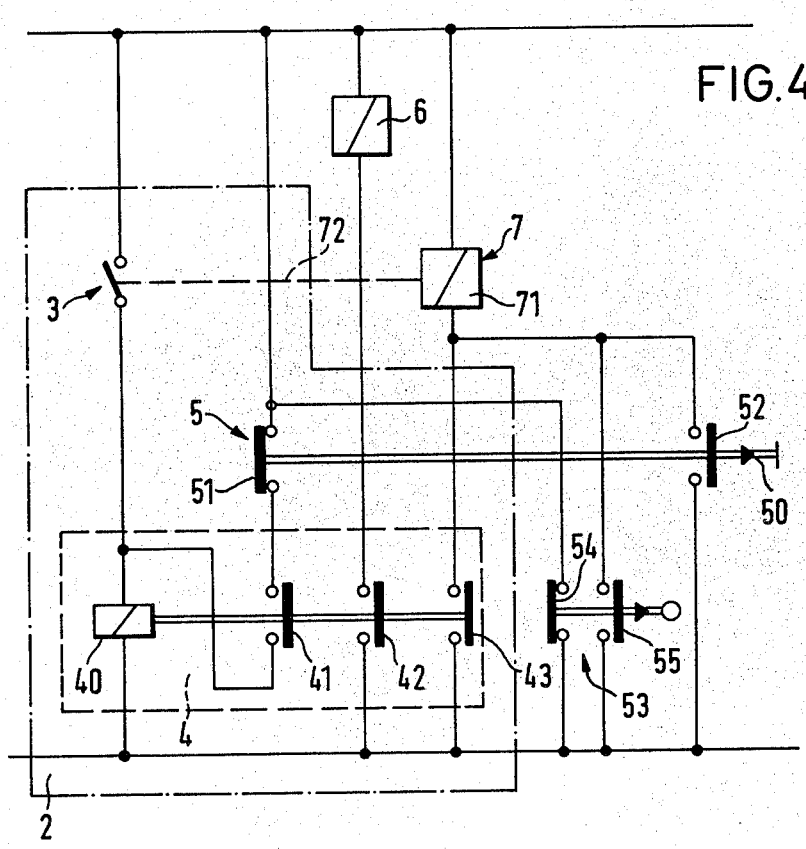
FIG. 4 is a schematic diagram of still another modified form of the invention.

FIG. 4 shows a further development of the mechanism shown in FIG. 2, in which the retainer 7 is made as a repulsion magnet 71 which moves the sensor 10 out of the yarn breakage position F into the position of readiness B. This repulsion magnet 71 is arranged in parallel with the control member 6 for the fiber feed device 60 (FIG. 1) and in series with the main switch member 4. The relay or contactor 40 forming the main switch member 4 has in series with the repulsion magnet 71 a contact 43 which is closed upon excitation of the relay or contactor 40.

Hence when in the yarn breakage position F the sensor 10 actuates the relay or contactor 40 via the switching-on member 3, the repulsion magnet 71 is energized and by means of its core 72 brings the sensor 10 (FIG. 2) into the position of readiness B.

In order that the repulsion magnet 71 may drop out with a delay independently of the start of the switching-on of the fiber feed, so that the sensor 10 only rests against the yarn 2 after yarn tension has been restored, the switching-off member 5 is made as a bypass to the main swtich member 4 which from now on keeps the repulsion magnet 71 switched on during the time of actuation of the switching-off member 5. For this purpose the pushbutton switch 50 forming the switching-off member 5 exhibits besides the contact 51 in series with the repulsion magnet 71 but in parallel with the contact 43, a second contact 52 which is closed upon actuation of the pushbutton switch 50 and hence even after dropping out of the relay or contactor 40 keeps the repulsion magnet 71 switched on until by releasing the pushbutton switch 50 the contact 52 is opened, whereupon the repulsion magnet 71 drops out and release the sensor 10 (FIG. 2). Hence even after the start of the fiber feed which starts at the instant of the actuation of the pushbutton switch 50, the sensor 10 until the instant of release of the pushbutton switch 50 remains still in its position of readiness B and only then moves into the sensing position A.

When joining in the case of yarn breakage where spinning is effected automatically the pushbutton switch 50 may be actuated both by a control mechanism for the removal of a yarn breakage and also in the case of bulk joining at all of the spinning units on a machine after a shutdown of it, from a central main control mechanism. In such case instead of a pushbutton switch 50 a time-switch, e.g., a time relay may be applied as the switching-off member 5, which is set in motion upon actuation of the switching-on member 3 or by a switching-on mechanism for the bulk joining.

When joining is effected by hand two further contacts 54 and 55 may be provided in parallel with the contacts 51 and 51 of the pushbutton switch 50, which are actuated automatically in the case of bulk joining. These contacts are part of a pushbutton switch 53 controlled by a starting and control drum or of a time-switch which in the way mentioned above gets set in motion upon switching-on of the machine and may be set appropriately for adaptation to variable spinning factors (material, etc.).

Upon switching on the machine the sensor 10 is already lying in the yarn breakage position F in which the control mechanism 6 as well as the repulsion magnet 71 are actuated. Hence the yarn feed device 60 which was switched off with the machine at standstill remains switched off from now on while the sensor 10 gets brought into the position of readiness B. The switching-off member (pushbutton switch 53) having the two contacts 54 and 55, which is effective in the case of bulk joining, becomes effective through the starting and control drum, the time-switch or the like, so that at the correct instant during the joining process first of all the fiber feed in started and then the sensor 10 is released.

It is obviously possible to make the control mechanism 6 for the fiber feed mechanism 60 in various ways too, e.g., as a clutch for an individual delivery roll or as a magnet for a clamping lever associated with a feed trough. In the executions described the fiber feed is switched off by switching on the control mechanism 6. By appropriate alteration of the circuit arrangement it is naturally also possible to make the switching mechanism 2 such that for switching on the fiber feed the control mechanism 6 is switched on too.

The individual switching members 3, 4 and 5 of the switching mechanism 2 may be made in various ways. Thus, for example, instead of a relay or contractor 40 for the main switch member 4 other switching elements, that is, both contact switches and also contactless switches, e.g., transitors may be used.

Figure 3:
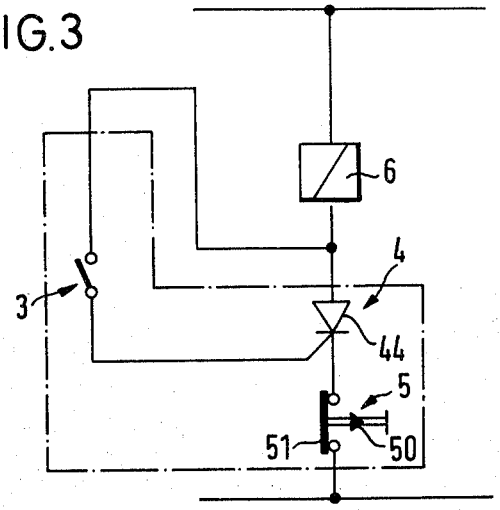
FIG. 3 is a schematic diagram illustrating a modified form of the invention.

In the embodiment shown in FIG. 3 the main switch member 4 is made as a thyristor 44, to which the switching-on member 3 feeds the ignition voltage. The switching-off member 5 is in that case arranged in series with the control member 6 for the fiber feed device (FIG. 1) and with the thyristor 44.

When the sensor 10 arrives in the yarn breakage position F the switching-on member 3 is actuated, which ignites the thyristor 44. The control mechanism 6 for the interruption of the fiber feed into the open-end spinning mechanism is thereby actuated. If the sensor is now moved into the position of readiness B this remains without influence upon the control mechanism 6 since the ignited thyristor 44 remains switched on even after release of the switch member 3. If during the joining process the pushbutton switch 50 interrupts the flow of current via the thyristor 44 the control mechanism 6 also drops out so that fibers are fed again into the open-end spinning mechanism. When the spun yarn 1 again exhibits the normal spinning tension the sensor 10 is released and now returns into the sensing position A.

Figure 5:
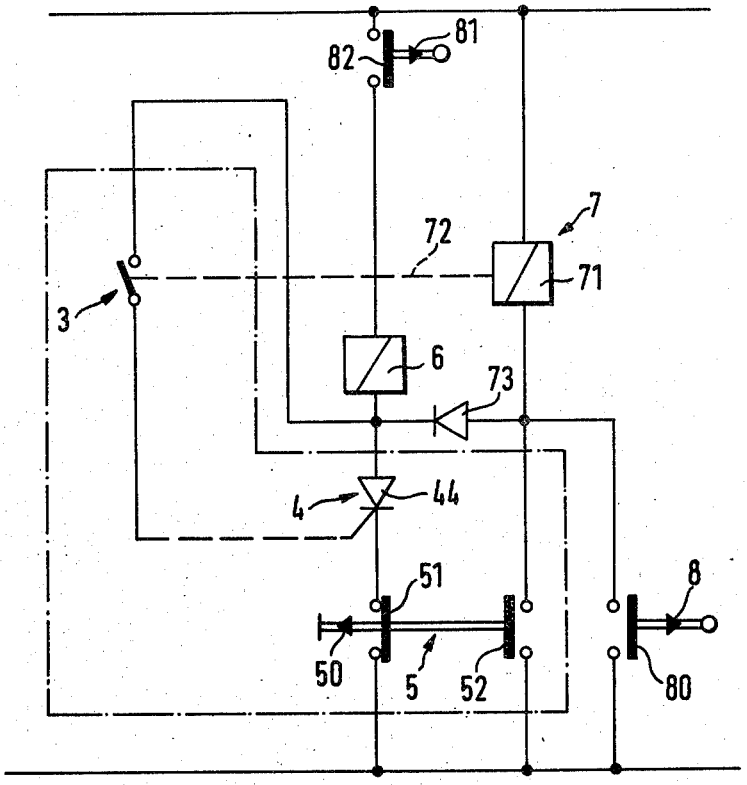
FIG. 5 is a further modified form of the invention.

In the case of the further refinement shown in FIG. 5, of the mechanism as FIG. 3, a retainer 7 in the form of a repulsion magnet 71 is again provided, which is connected in parallel with the control mechanism 6 and in series with the thyristor 44 and hence is switched-on simultaneously with the latter when the thyristor 44 is ignited. Hence, hardly has the sensor 10 in the yarn breakage position F actuated the switching-on member 3, than the repulsion magnet 71 brings the sensor 10 into the position of readiness B while at the same time the fiber feed into the open-end spinning mechanism is cut off.

For switching-on the fiber feed, just as in the case of the embodiment shown in FIG. 4, a pushbutton switch 50 is provided having respective contacts 51 and 52 in the supply lead to the control mechanism 6 and the repulsion magnet 71. Hence in the case of this embodiment too the sensor 10 remains in the position of readiness B until after release of the pushbutton switch 50. The diode 73 in the connecting lead which connects the lead between the repulsion magnet 71 and the contact 52 to the lead between the control mechanism 6 and the thyristor 44 prevents the control mechanism 6 from remaining switched-on via the contact 52 in the case of the thyristor 44 being switched off, and hence insures that the fiber feed into the open-end spinning mechanism starts already upon actuation of the pushbutton switch 50.

For bulk joining just as in the case of the embodiment shown with the aid of FIG. 4, further contacts may be provided in parallel with the contacts 51 and 52 so that the joining is effected automatically in a similar way to that case, while the removal of yarn breakage is performed by hand. In this way it becomes possible for the sensor 10 to be brought into the position of readiness B already before the bulk joining, and hence the yarn 1 experiences no deflection during the bulk joining.

In accordance with FIG. 5 another form is provided in which a pushbutton switch 8 controlled by a main control mechanism (not shown) is arranged with its contact 80 in series with the repulsion magnet 71 and in parallel with the contacts 51 and 52 of the pushbutton switch 50 as well as with the main switch member 4. Furthermore, a further pushbutton switch 81 controlled by the main control mechanism (not shown) is provided with its contact 82 in series with the thyristor 44. The contact 82 of the pushbutton switch 81 is during standstill of the machine released by the main control mechanism, after the feed mechanism 60 has become stationary and the fiber feed into the open-end spinning mechanism has been stopped. By doing that it is not possible to ignite the thyristor 44. During joining the contact 80 of the pushbutton switch 8 is closed from the main control mechanism so that the sensor 10 moves from the yarn breakage position F in which it is lying during standstill of the machine, into the position of readiness B. At a given moment the fiber feed is switched-on by the main control mechanism by switching on the drive of the delivery rolls and the release rolls. Since through interruption of the flow of current by means of the pushbutton switch 81 the thyristor 44 cannot be ignited, the switching mechanism 2 in accordance with the invention also cannot interrupt the fiber feed. Since the ignition of the thyristor 44 gets cut off during joining by the contact 82, extinguishing later by additional contacts which are arranged in parallel with the contacts 51 and 52 is not necessary. After the conclusion of the joining process the pushbutton switches 8 and 81 are released so that the sensor 10 rests against the yarn 1 again and the switching mechanism 2 again becomes effective.

Instead of the pushbutton switch 50 with the contacts 51 and 52 working in alternation and instead of the pushbutton switch 53 with the contacts 54 and 55 likewise working in alternation a changeover switch (not shown) may also be provided in each case, which is provided between the connecting lead provided with the diode 73 and the control mechanism 6 and connects the thyristor 44 optionally to the control mechanism 6 and to a lead to the network arranged in parallel with it. In the first position of the changeover switch it connects the control mechanism 6 to the thyristor 44 so that the fiber feed gets switched on, while the repulsion magnet 71 remains still excited via the changeover switch and the parallel lead short-circuiting the thyristor 44. Hence the thyristor 44 becomes extinguished so that upon release of the changeover switch again into the position in which it again connects the thyristor 44 and the switching mechanism 6, it is no longer in the conductive state.

The switch 8 as well as the switch 81 may be made in various ways too.

The present description shows that the invention may be altered in various ways. Further alterations through equivalents are possible at any time.

What is claimed is:

1. A control mechanism for a fiber feed device on an open-end spinning machine including a sensor sensing tension in yarn being produced, a control member controlling the operation of said fiber feed device, and a switching mechanism connected to said sensor and said control member controlling the operation of said fiber feed device responsive to a drop in tension in said yarn being produced comprising: said switching mechanism (2) including;

(i) a switch-on member (3) activated upon drop in yarn tension, (ii) a main switch member (4) electrically connected to said switch-on member (3) being switched on upon actuation of said switch-on member (3) for putting said sensor (10) and said fiber feed device (60) out of service, (iii) said main switch member (4) including an interlock means for maintaining said main switch member (4) in said switched-on state even if said switch-on member is deactivated, and (iv) a switch off member (5) electrically connected to said main switch member (4) for putting said sensor (10) and said fiber feed device (60) into service.

2. A control mechanism for a fiber feed device on an open-end spinning machine including a sensor sensing tension in yarn being produced, a control member controlling the operation of said fiber feed device, and a switching mechanism connected to said sensor and said control member controlling the operation of said fiber feed device responsive to a drop in tension in said yarn being produced comprising:

said switching mechanism (2) including;

(i) a switch-on member (3) actuable upon drop in yarn tension, (ii) a main switch member (4) being switched on upon actuation of said switch-on member (3) for putting said sensor (10) and fiber device (60) out of service, (iii) a switch off member (5) for switching off said main switch member (4) for putting said sensor (10) and said fiber feed device (60) into service, and a repulsion magnet (71) arranged in parallel with said control member (6) for said feed device (60) and in series with said main switch member (4), for moving said sensor out of the position (F) it lies in the case of yarn breakage to another position (B).

3. The control mechanism as set forth in claim 1 further comprising:

said switching-off member being a pushbutton switch (50).

4. A control mechanism as set forth in claim 2 further comprising:

said switching-off member (5) is made as a bypass to said main switch member (4), which keeps said repulsion magnet (71) switched on during the actuation of said switching-off member (5).

5. The control mechanism as set forth in claim 2 further comprising:

a switch member (8) provided in series with said repulsion magnet (71) and in parallel with said main switch member (4) for selectively energizing and de-energizing said magnet 71 for moving said sensor out of the position (f) where it lies in the case of yarn breakage to a position of readiness.

* * * * *